United States Patent [19]

Opland et al.

[11] 4,095,450

[45] Jun. 20, 1978

[54] AXLE MAKING METHOD AND APPARATUS

[75] Inventors: Harry Opland, Madison Heights; Ralph S. Sharpe, Livonia; Joseph H. Zawacki, Detroit, all of Mich.

[73] Assignee: Lear Siegler, Inc., Detroit, Mich.

[21] Appl. No.: 779,444

[22] Filed: Mar. 21, 1977

[51] Int. Cl.[2] ..... B21K 1/12

[52] U.S. Cl. ..... 72/318; 72/356; 72/359; 72/367

[58] Field of Search ..... 301/124 R, 127; 72/367, 72/416, 358, 359, 318, 322, 356; 29/155 R, 155 C

[56] References Cited

U.S. PATENT DOCUMENTS

| | | | |
|---|---|---|---|
| 601,262 | 3/1898 | Keithley | 72/416 |
| 807,832 | 12/1905 | Lindsay | 301/124 R |
| 840,945 | 1/1907 | Lane | 301/124 R |
| 1,917,502 | 7/1933 | Crawford et al. | 72/367 |
| 2,313,116 | 3/1943 | Babcock | 72/356 |

*Primary Examiner*—Lowell A. Larson

*Attorney, Agent, or Firm*—Reising, Ethington, Barnard, Perry & Brooks

[57] ABSTRACT

An axle making method and apparatus for forming a unitary tubular axle blank with an I-beam section along an intermediate axle portion and with a bifurcated axle end for supporting a wheel spindle by ball joints. Inward deformations are formed in side walls of the intermediate axle portion to form the I-beam section by apparatus including a pair of punches with opposed forming projections between which the blank is received. Apparatus for forming the bifurcated axle end incorporates cooperable female dies and male punches with complementary work surfaces for forming the projections from a notched axle blank end and with edge work surfaces on the punch for axially upsetting webbed side walls extending between the projections in order to maintain the wall thickness of the webbed side walls at least as great as the wall thickness of the intermediate axle portion.

19 Claims, 11 Drawing Figures

AXLE MAKING METHOD AND APPARATUS

BACKGROUND OF THE INVENTION

1. Field of the Invention

This invention relates to a method and apparatus for making a vehicle axle.

2. Description of the Prior Art

Axles for vehicles have previously been manufactured from tubular blanks with ends that are formed so as to be capable of supporting associated wheels. One type of axle end supports a king pin used to pivotally mount a wheel spindle about an axis around which the wheel is turned. Another type of axle is made from a two piece construction including upper and lower members that are stamped and welded to each other with associated projections thereof at an end of the axle provided for mounting ball joints that support the wheel spindle. This latter type of axle has a bifurcated end shape where stress concentration can occur at the welds between the two members.

In manufacturing vehicle axles from tubular blanks of a uniform wall thickness, sometimes the combined height and width of the axle required for strength at certain locations is greater than the combined height and width that can be utilized at other locations without interference between the axle and other vehicle components during axle movement.

Of course, axles have also been made of a solid construction in addition to hollow axles that are made from either a tubular or two piece construction as described above. Solid axles are usually made by a forging process and necessarily have a smaller strength to weight ratio than hollow axles since more material of the axle is located adjacent the neutral axes of twisting and bending than is the case with hollow axles. U.S. Patents relating to axles are as follows; U.S. Pat. Nos. 2,007,793; 2,053,975; 2,124,406; 2,752,673; 2,911,264; and 3,804,467.

SUMMARY OF THE INVENTION

An object of the present invention is to provide an improved method and apparatus for forming a vehicle axle from a tubular axle blank of a unitary construction. In carrying out this object, an intermediate portion of the axle blank has side walls thereof deformed inwardly toward each other to form an I-beam section with a smaller combined height and width than the intermediate axle portion before the deformation. Also, a pair of end notches formed in the blank define a pair of projections that are formed by die and punch apparatus into a bifurcated axle end with webbed side walls extending between the projections and axially upset during the forming so as to have a wall thickness at least as great as the wall thickness of the intermediate axle portion.

Apparatus for forming the I-beam axle section includes a pair of punches each of which has a forming face including a forming projection extending outwardly therefrom toward the other punch in an opposed relationship. Each of the punches is mounted on a ram means that is actuated to move the punches relative to each other with the axle blank therebetween so that the forming projections engage the intermediate axle portion side walls and deform the side walls inwardly toward each other to provide the I-beam section. Preferably, each forming projection has a smoothly curved shape and the deformation of the axle portion side walls is performed sufficiently far so that the deformations engage each other and cooperate with upper and lower walls of the intermediate axle portion in providing structural interconnection between the side walls. This deformation of each side wall is performed simultaneously and results in smoothly curved deformations that form the I-beam section.

Apparatus for making the bifurcated axle end incorporates a female die having a work opening in which a tubular axle blank end is received and a male punch that is impacted with a pair of projections formed by end notches in the blank end and concomitantly impacted with webbed side walls of the axle end. Two die and punch sets are preferably utilized, one set being utilized to perform an initial bending of at least one of the projections and formation of the webbed side walls, and the other set being utilized to finally form the end section of the bent projection and to provide a final axial upsetting that thickens the webbed side walls. Preferably, two impacts using the second set are performed with the axle blank positioned forwardly by a spacer during the second impact so the webbed side walls thereof are subjected to the impact thickening.

Both female dies have a pair of projection work surfaces with at least one of these surfaces having support and end section surface portions oriented in a skewed relationship with respect to the other. Each punch likewise has complementary projection work surfaces for cooperating with the associated die in forming the projections. One of the blank projections which forms the lower projection in the resultant axle is cut off before the forming begins so that it has the same length as the finally formed upper projection. Each female die and male punch also has a pair of side wall work surfaces that are complementary and open in an outwardly facing direction. A body portion of each male punch defines its work surfaces and has a leading nose which is initially received within the axle blank end during the impact forming. Edge work surfaces of the punch body extend between the projection work surfaces to engage the axle blank within the notches and to thereby provide the axial upsetting of the webbed side walls.

One male punch used to initially form the projections has its edge work surfaces provided with leading ends of pointed configurations that are directed toward the nose. The other male punch used to subsequently form the projections has its edge work surfaces provided with smoothly curved leading ends that provide the final shape of the webbed side walls on the axle end. A pair of parallel intermediate surface portions of each edge work surface on the latter punch extend from each curved leading end and are connected with trailing axial ends of the edge work surfaces. The axial ends interconnect the edge work surfaces at spaced upper and lower locations.

Preferably, the bifurcated axle end with the upper and lower projections is formed adjacent an intermediate axle portion rectangular section with upper and lower walls and spaced side walls. The I-beam section of the intermediate axle portion is formed adjacent the rectangular section in a spaced relationship from the bifurcated axle end. As a result of the inward side wall deformations, the I-beam section has a combined height and width that is less than the combined height and width of the rectangular section so as to facilitate use of the axle with certain vehicle underbody constructions.

The objects, features and advantages of the present invention are readily apparent from the following detailed description of the preferred embodiments taken in connection with the accompanying drawings.

DETAILED DESCRIPTION OF THE PREFERRED EMBODIMENTS

Figure 1:
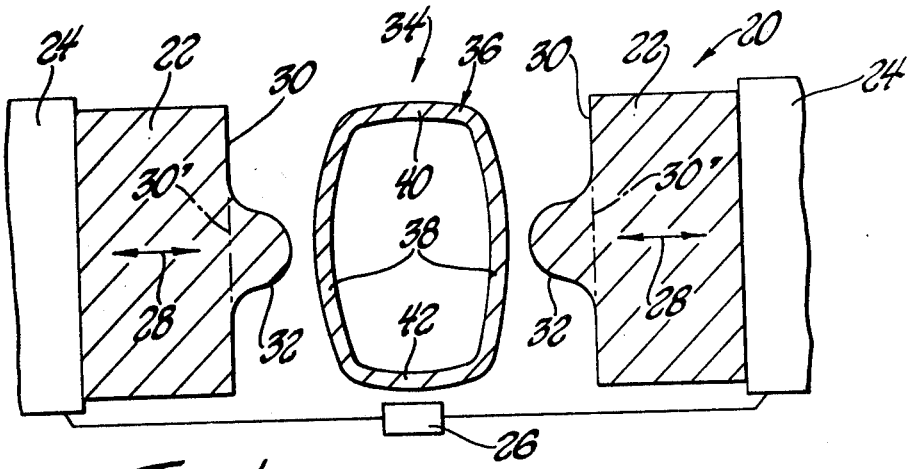
FIG. 1 is a sectional view of axle making apparatus constructed according to the present invention and utilized in accordance with the method thereof to form the axle blank shown into an I-beam section.

Referring to FIG. 1 of the drawings, apparatus 20 constructed according to the present invention and utilized in accordance with the method thereof includes a pair of punches 22 mounted on respective movable rams 24. A control 26 is connected to each of the rams 24 to move the punches 22 simultaneously toward or away from each other as shown by arrows 28. Each punch 22 has a forming face 30 that is arranged in an opposed relationship to the forming face of the other punch. Forming projections 32 of each punch forming face extend outwardly therefrom toward the opposite punch with a smoothly curved shape.

An axle blank 34 of a unitary tubular construction with an intermediate axle portion 36 is positioned between the punches 22 in their retracted position of FIG. 1 spaced away from each other the distance shown. This axle blank is formed from planar steel stock and then edge welded along a seam of the blank to provide its enclosed hollow structure. While the axle blank has a round shape after the welding, it may be initially formed with a slightly oval construction as shown in FIG. 1 prior to being formed by the punch apparatus 20. Suitable clamping apparatus is utilized to position the intermediate axle portion 36 between the punches 22 ready to be formed upon actuation of the control 26. Each punch projection 32 is then located adjacent an associated side wall 38 of the axle blank. Upper and lower walls 40 and 42 of the axle blank connect the side walls which are located in a spaced relationship to each other.

Figure 2:
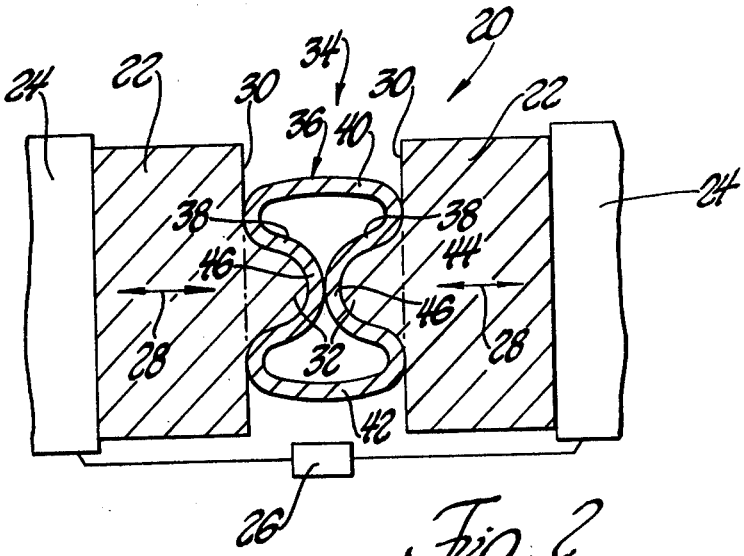
FIG. 2 is a sectional view of the apparatus shown after the intermediate axle portion axle has been formed into an I-beam section.

Actuation of the control 26 causes the rams 24 to move punches 22 toward each other from the position of FIG. 1 to the position of FIG. 2 in order to form the intermediate axle portion I-beam section 44 shown. As the movement of the punches 22 toward each other proceeds, the punch forming projections 32 form the inward deformations 46 that extend toward each other with the smoothly curved shapes of the forming projections. The resultant I-beam section 44 has a smaller combined height and width than the intermediate axle portion 36 before deformation so that the resultant axle can be utilized with certain vehicle underbody constructions where interference between the axle and the vehicle underbody would take place otherwise. Inner sides of the side wall deformations 46 preferably engage each other so as to provide interconnection and reinforcement between the side walls in addition to that provided by the upper and lower walls 40 and 42.

Figure 3:
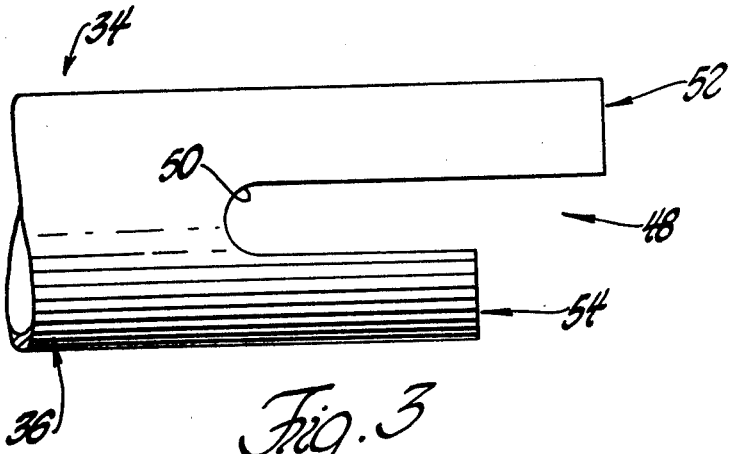
FIG. 3 is a side view of an axle blank end which is formed into a bifurcated axle end by female die and male punch sets of apparatus constructed according to the invention.

The end 48 of the axle blank 34 shown in FIG. 3 is first formed to include a pair of end notches 50 along its sides so as to define upper and lower projections 52 and 54 that are ultimately formed to provide upper and lower projections used to mount ball joints for supporting a wheel spindle. The lower projection 54 is cut off before the forming takes place so that both projections terminate at the same location after forming of the projections in the manner hereinafter described. Also, it should be noted that the steel tubular blank which is formed is preferably heat treated so that thinner stock can be utilized without a reduction in strength of the axle.

Figure 4:
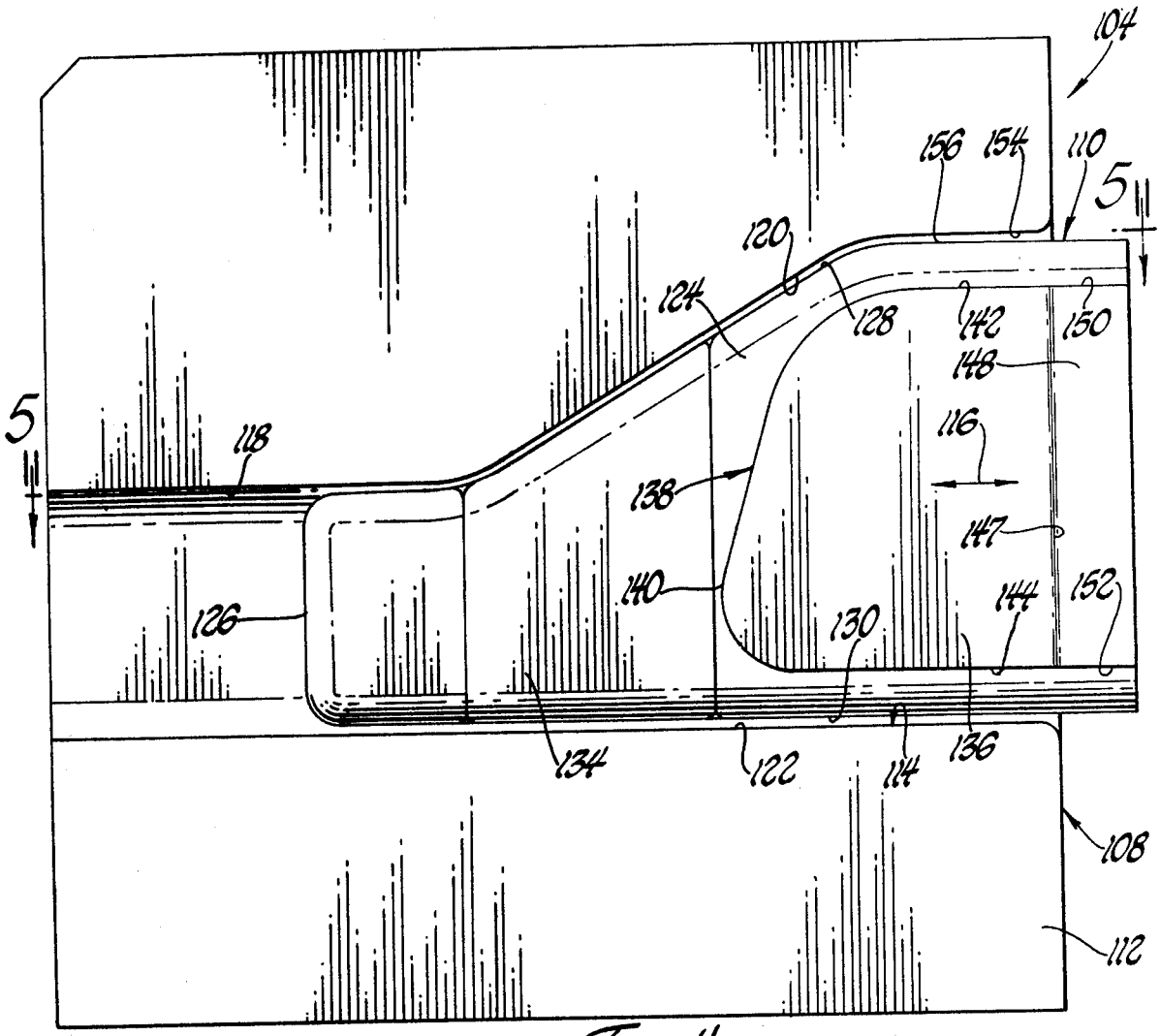
FIG. 4 is a side elevation view of a first female die and male punch set used to form the axle blank end shown in FIG. 3.
Figure 5:
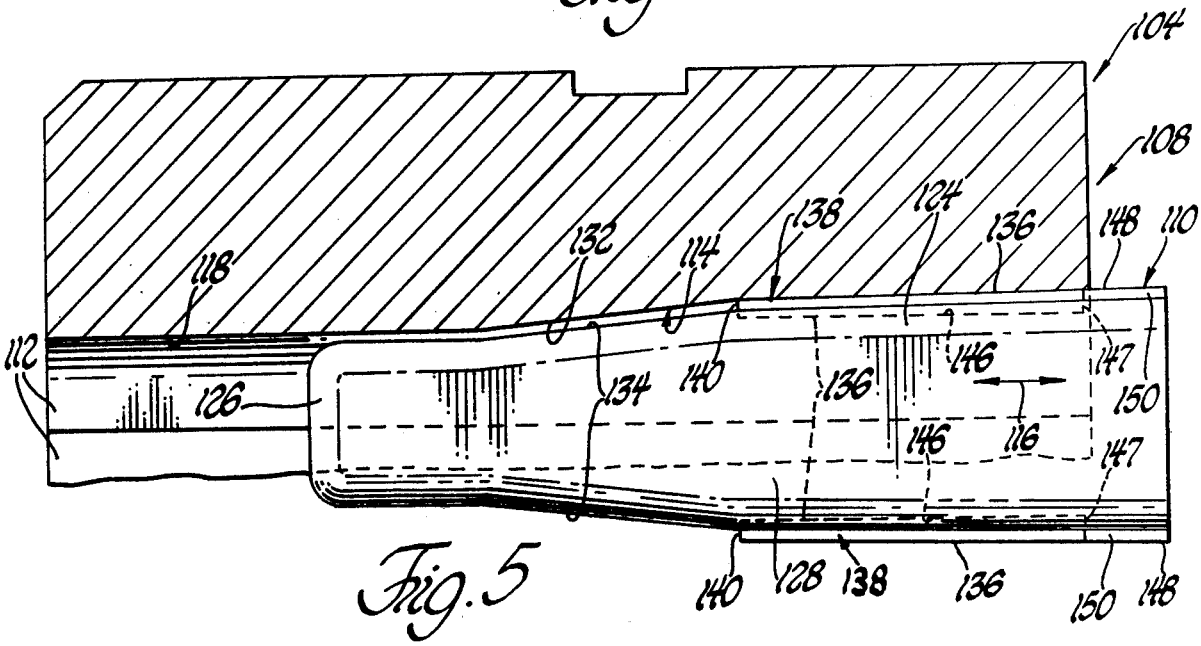
FIG. 5 is a plan view taken partially in section of the die and punch set taken along line 5—5 of FIG. 4.
Figure 6:
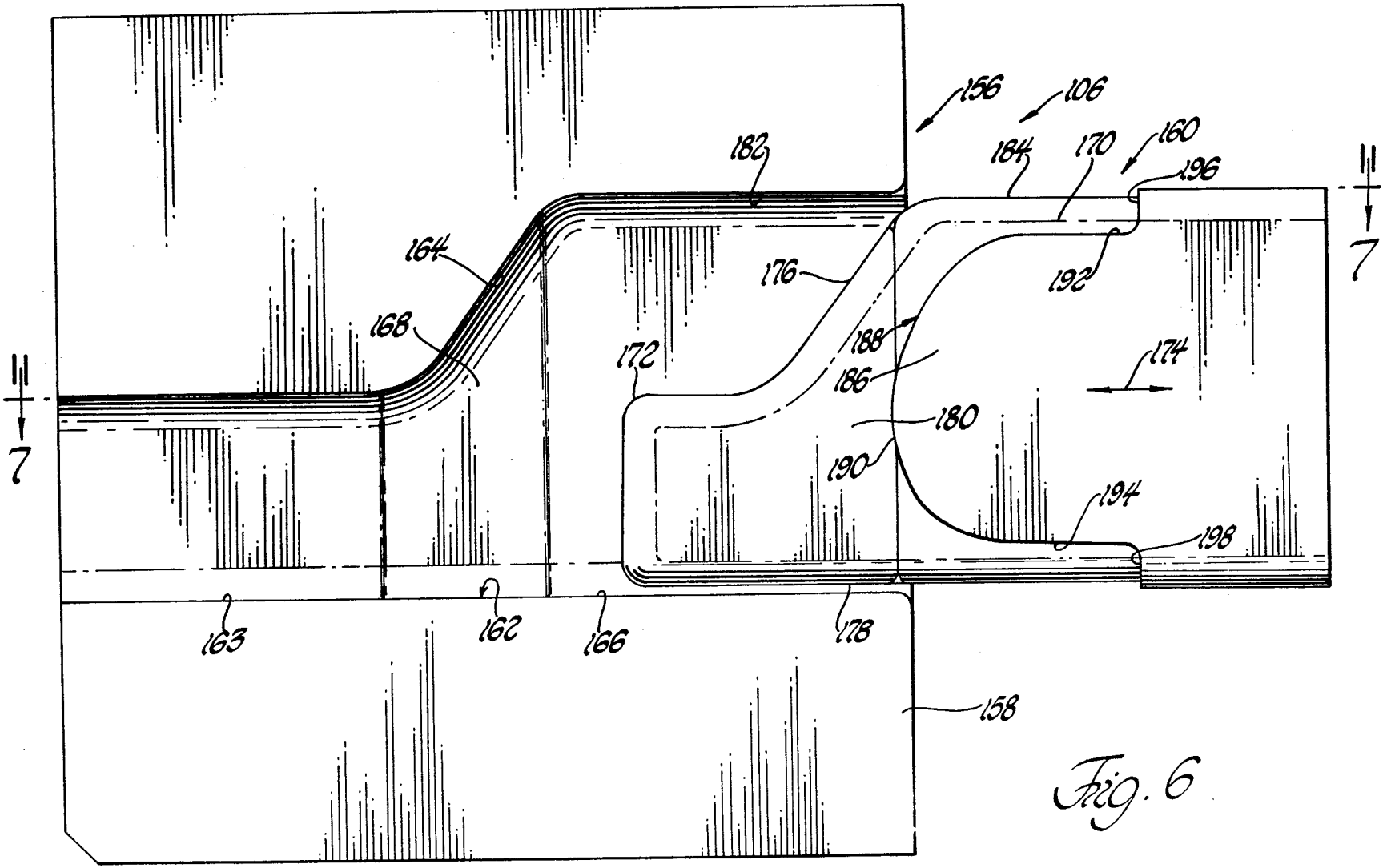
FIG. 6 is a side elevation view of a second female die and male punch set utilized to form the axle blank end after an initial forming by the die and punch set of FIGS. 4 and 5.
Figures 7, 8, 9, 10, 11:
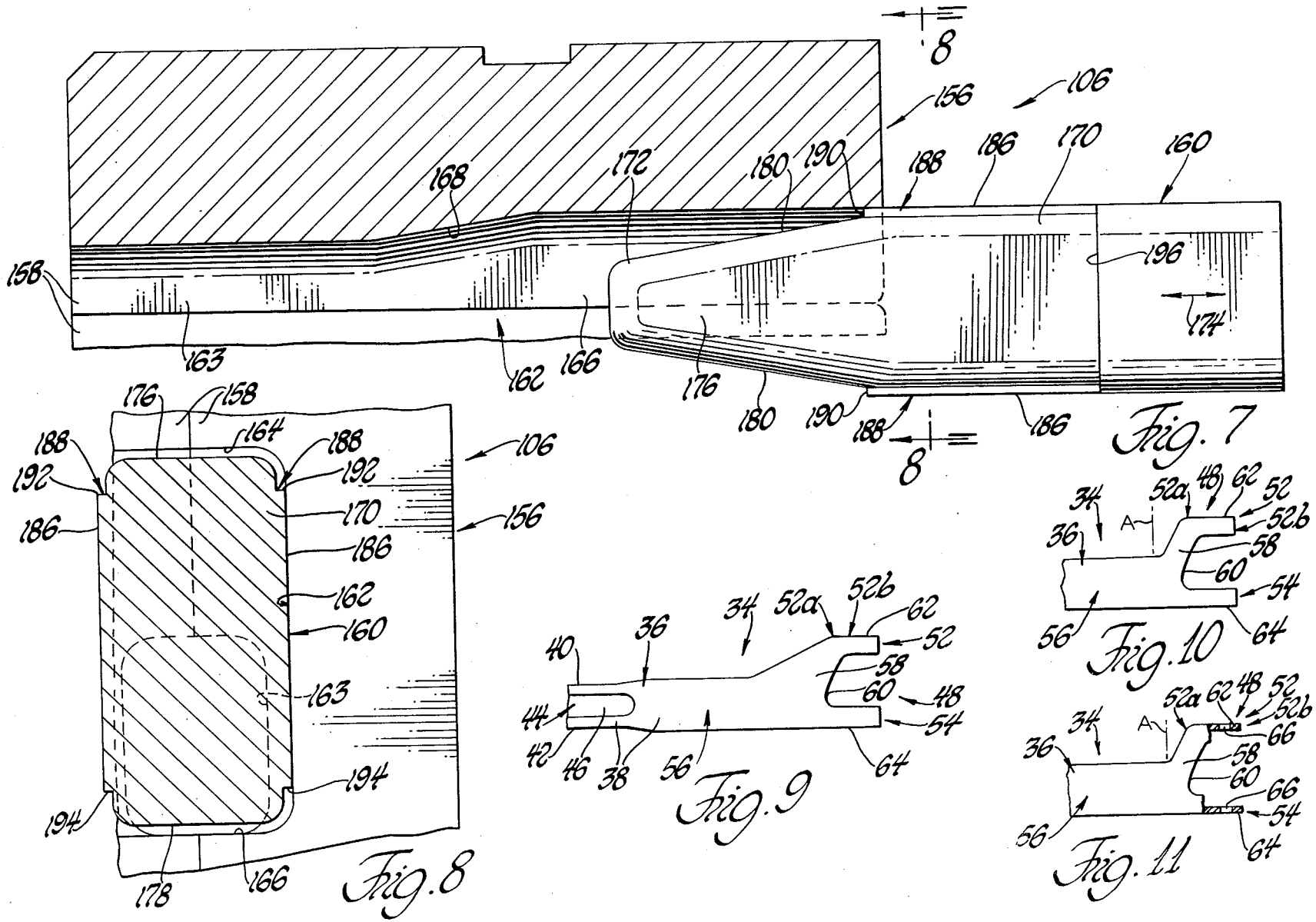
FIG. 7 is a plan view taken partially in section of the second die and punch set along line 7—7 of FIG. 6.
FIG. 8 is an elevation view taken partially in section along line 8—8 of FIG. 7 showing the second die and punch set.
FIG. 9 is a view showing the axle blank end of FIG. 3 after it has been formed by the first die and punch set of FIGS. 4 and 5.
FIG. 10 is a view showing the axle blank end after it has been formed by a first operation of the die and punch set of FIGS. 6–8.
FIG. 11 is a partially broken away view of the axle blank end after it has been formed by a second operation of the die and punch set shown in FIGS. 6–8.

Apparatus for forming the axle blank end 48 of FIG. 3 is disclosed in FIGS. 4–8 and includes first and second die and punch sets 104 and 106. Die and punch set 104 is shown in FIGS. 4 and 5 while die and punch set 106 is shown in FIGS. 6–8. After heating the blank end, three impacts are performed on the axle blank end by the die and punch sets, one by the first set 104 and two by the second set 106. After the first impact performed by the die and punch set 104 the axle blank is formed to the configuration shown by FIG. 9. Die and punch set 106 then forms the axle blank end to the configuration shown by FIG. 10 by an impact. Subsequently, the axle blank is again formed by an impact of die and punch set 106 with a spacer positioning it forwardly from the location of the previous operation so that the walls of the finally formed axle end 48 shown in FIG. 11 are axially upset to make sure that the thickness thereof is at least as great as the thickness of the intermediate axle portion as was previously discussed.

Also, it should be noted in FIG. 9 that the I-beam section 44 is spaced from the axle end 48 by a rectangular section 56 of the intermediate axle portion. At the rectangular section 56, the intermediate axle portion upper, lower and side walls have a combined height and width greater than at the I-beam section 44. This structure allows the axle end to have the required strength to support a wheel spindle during use in certain vehicle underbody constructions where the I-beam section would not be free for movement without interference were it not formed as described. Rectangular section 56 can be formed prior to, at the same time as, or after the forming of the I-beam section 44. When the rectangular section 56 is formed at the same time as the I-beam section 44, the punch forming faces 30 have flat surface portions 30' that engage the side walls 38 of the axle blank at axially spaced locations from the projections 32.

The first die and punch set 104 which initially forms the axle blank end is shown in FIGS. 4 and 5 as including a female die 108 and a male punch 110. Die 108 includes a pair of symmetrical die sections 112 (FIG. 5) that cooperatively define a work opening 114 in which the axle blank is forged after first being heated to a hot forging temperature. Mounting of the female die sections 108 on a conventional forging machine so as to clamp the axle blank stationary in a sideways manner and mounting of the punch 110 on a movable ram for reciprocation in the direction shown by arrows 116 allows the axle blank end to be forced to the configuration shown in FIG. 9.

Die sections 112 shown in FIGS. 4 and 5 cooperatively define a rectangular shape at the left end 118 of the work opening 114 in order to permit the axle blank being formed to be clamped sideways in a fixed position. Work opening 114 has a right end that opens outwardly to receive the punch and includes upper and lower projection work surfaces 120 and 122. Punch 110 includes a body portion 124 and a nose 126 that is received within the axle blank end in the fully inserted position of the punch shown. Upper and lower projection work surfaces 128 and 130 on punch body portion 124 are complementary to the die work surfaces 120 and 122 so as to cooperate therewith in forming the axle end projections to the configuration shown in FIG. 9 where the longer upper projection 52 is bent upwardly to include a support section **52*a* and an end section 52*b* that extends from the support section in a skewed relationship thereto parallel to the lower projection 54. Webbed side walls 58 are formed during the bending of the upper projection and extend between the upper and lower projections in a spaced relationship to each other. Side wall work surfaces 132 and 134 on the die sections and the punch, respectively, are complementary to each other located inwardly from the projection work surfaces and extend away from each other to provide an outwardly opening shape to the side walls 58. Punch nose 126 projects in a leading direction from the side wall work surfaces 134 to be received within the rectangular shape of the work opening 114 at its left end 118**.

With continuing reference to FIGS. 4 and 5, a pair of plates 136 are fixedly secured in a suitable manner to opposite sides of the punch body portion 124 and have edge work surfaces 138 that engage the axle blank within the notches formed therein to provide the initial forming of edges 60 (FIG. 9) on the webbed side walls 58 of the axle end. Leading ends 140 of each edge work surface have a pointed configuration as best seen in FIG. 4 that is directed toward the punch nose 126. Upper and lower surface portions 142 and 144 of each edge work surface 138 extend from the leading end 140 to the trailing end of the punch at the right as shown. Each plate 136 is received within a shallow depression 146 (FIG. 5) and has a trailing edge 147 engaged with an integral projection 148 on the punch body. Upper and lower edge surfaces 150 and 152 of each projection 148 form continuations of the work surface portions 142 and 144, respectively. The upper projection work surfaces 120 and 128 on the die and punch body have respective end portions 154 and 156 shown in FIG. 4 that are complementary to each other to form the end section of the upper projection and which extend parallel to the lower projection work surfaces 122 and 130.

After the axle blank has been forged by the first die and punch set 104 shown in FIGS. 4 and 5 so that it has the configuration of FIG. 9 with its webbed side wall edges 60 somewhat pointed, two subsequent forging steps are performed with the second die and punch set 106 shown in FIGS. 6–8. This die and punch set includes a female die 156 having a pair of symmetrical die sections 158 and also includes a male punch 160 of a unitary construction. Die sections 158 of the female die cooperatively define a work opening 162 in which the axle blank end is forged. As viewed in FIGS. 6 and 7, the left end 163 of work opening 162 has a smaller size than its right end and defines a rectangular shape that can be seen in FIG. 8. Die sections 158 clamp the partially formed axle within the rectangular work opening end 163 in a sideways manner so that punch 160 can perform two forging impacts on the axle end. Work opening 162 also includes upper and lower projection work surfaces 164 and 166 that are oriented in a skewed relationship with respect to each other. Side wall work surfaces 168 of the die sections 158 extend between the work surfaces 164 and 168 and extend away from each other in an outwardly opening direction from the rectangular work opening end 163.

Punch 160 has a body portion 170 and a nose 172 that projects to the left in a leading direction from the body portion as best seen in FIG. 6. A movable ram (not shown) reciprocates the punch 160 as shown by arrows 174 so that the punch is received within the work opening 162 with its nose 172 inserted within the axle end being forged. Upper and lower projection work surfaces 176 and 178 of punch body 170 are oriented in a skewed relationship with respect to each other and are complementary to the upper and lower projection work surfaces 164 and 166 on the die work opening so as to cooperate therewith in forging the axle and projections as the punch is inserted within the die. Side wall work surfaces 180 of punch body 170 extend between the projection work surfaces 176 and 180 and, as seen in FIG. 7, extend away from each other in a complementary relationship with respect to the side wall work surfaces 168 of the die sections 158 so as to cooperate therewith in forming the webbed side walls 58 of the axle end as shown in FIG. 10. Upper projection work surfaces 164 and 176 on the die and punch respectively include end surface portions 182 and 184 that extend parallel to the lower projection work surfaces 166 and 178 of the punch to form the upper projection end section **52*b***.

Punch 160 shown in FIGS. 6–8 has side projections 186 that define edge work surfaces 188 used to axially upset the webbed side walls 58 between the upper and lower projections of the axle end. Each edge work surface 188 has a curved leading end 190 (FIG. 6) that forms the adjacent webbed side wall 58 of the axle end with the curved edge 60 shown in FIG. 10. Upper and lower intermediate surface portions 192 and 194 of each edge work surface 188 extend from the curved leading end 190 thereof to upper and lower axial trailing ends 196 and 198 of the edge work surfaces. Each trailing end 196 and 198 of the edge work surfaces extends between the opposite sides of punch body 170 as shown in FIG. 7.

Hot forging of the axle end from its shape shown in FIG. 9 by the die and punch set 106 of FIGS. 6–8 forms the axle end to its shape shown in FIG. 10 which is generally like the final shape of the axle end. Punch nose 172 is received within the axle end as the punch 160 is impacted within the work opening and the complementary work surfaces of the die 156 and the punch then form the axle end to its FIG. 10 shape. After a first forging stroke of the punch 160, the die sections 158 are moved away from each other to unclamp the axle which is then moved forwardly to the right toward the withdrawn punch about a half inch or so with an insert inserted against a stop in engagement with the other end of the axle so as to be located with its end projections to the right of the location thereof after the previous forging stroke. A subsequent forging stroke of the punch 160 then impacts the edge work surface 188 of the punch with the webbed side wall edges 60 and the ends of the upper and lower projections 52 and 54. Each webbed side wall 58 and upper and lower walls 62 and 64 of the projections are moved to the left and thickened during this second forging operation with punch 160 so that the wall thickness thereof is at least as great as (and in fact sometimes greater than) the wall thickness of the intermediate axle portion that supports the axle end. Leading ends 190 of the edge work surfaces 188 thicken the webbed side walls 58 of the axle end while the trailing ends 196 and 198 of the edge work surfaces thicken the upper and lower walls of the projections. Reference line A in FIGS. 10 and 11 is located at the same location with respect to the intermediate axle portion 36 but shows that the second axial upsetting impact moves the axle end 48 slightly to the left.

Ball joint mounting holes 66 are formed in the upper and lower walls 62 and 64 of the projections as shown in FIG. 11. A wheel spindle (not shown) is supported by upper and lower ball joints mounted within these holes 66.

While preferred embodiments of the method and apparatus for making an axle have herein described in detail, those familiar with this art will recognize various alternative ways of practicing the present invention as defined by the following claims.

We claim:

1. A method for making an axle from a tubular axle blank of a unitary construction having an end including upper and lower walls and also having an intermediate portion including spaced side walls and upper and lower walls connecting the side walls, the method comprising: forming the upper and lower walls of the axle end to provide upper and lower projections spaced vertically from each other; and deforming the side walls inwardly toward each other at a location spaced from the axle end to form an I-beam section with a smaller combined height and width than the intermediate axle portion immediately adjacent the axle end.

2. A method as in claim 1 wherein the side walls are deformed inwardly sufficiently so as to engage each other.

3. A method as in claim 1 wherein the side walls are simultaneously deformed inwardly to define smoothly curved shapes that form the I-beam section.

4. A method for making an axle from a tubular axle blank having an end including upper and lower walls and also having an intermediate portion including spaced side walls and upper and lower walls connecting the side walls, the method comprising: forming the upper and lower walls of the axle end to provide upper and lower projections spaced vertically from each other; and deforming the side walls inwardly toward each other at a location spaced from the axle end to define smoothly curved shapes that engage each other to form an I-beam section with a combined height and width less than the combined height and width of the intermediate axle portion immediately adjacent the axle end.

5. A method for making an axle from a tubular axle blank of a unitary construction, the method comprising: forming a pair of end notches in the blank to provide a pair of projections; bending at least one of the projections away from the other projection to thereby provide webbed side walls extending between the projections; axially upsetting the webbed side walls to increase the wall thickness thereof; and forming holes in the projections for mounting ball joints used to support a wheel spindle.

6. A method for making an axle from a tubular axle blank of a unitary construction, the method comprising: forming a pair of end notches in the blank to provide a pair of projections; cutting off one of the projections so as to be shorter than the other projection; bending the longer projection away from the shorter projection to thereby provide webbed side walls extending between the projections; and axially upsetting the webbed side walls to increase the wall thickness thereof.

7. A method as in claim 6 wherein the projections are axially upset concomitantly with the webbed side walls.

8. A method as in claim 6 wherein the webbed side walls are moved away from each other during the bending of the longer projection.

9. A method as in claim 6 wherein the longer projection is bent to form a support section that extends in a skewed relationship to the shorter projection and to form an end section that extends from the support section parallel to the shorter projection.

10. A method for making an axle from a tubular axle blank of a unitary construction, the method comprising: forming a pair of end notches in the blank to provide a pair of projections; cutting off one of the projections so as to be shorter than the other projection; bending the longer projection away from the shorter projection to form a support section and an end section that extends from the support section as well as forming webbed side walls that extend between the projections and are moved away from each other during the bending; and axially upsetting the webbed side walls to increase the wall thickness thereof.

11. Apparatus for making a wheel supporting axle and from an elongated tubular axle blank comprising: a female die including an open ended work opening for receiving a tubular axle blank having a pair of end notches forming a pair of end projections; the work opening including apair of projection work surfaces; one projection work surface having support and end section surface portions oriented in a skewed relationship with respect to each other; the work opening also including a pair of side wall work surfaces extending between the projection work surfaces; a male punch that is impacted with the axle blank within the work opening; the punch having a body portion and a nose projecting from the body portion; a pair of projection work surfaces and a pair of side wall work surfaces on the punch body portion complementary to the work surfaces of the work opening in the female die; the punch nose projecting forwardly from the body portion and being received within the axle blank during the impacting; and a pair of spaced edge work surfaces on the punch extending between the projection work surfaces thereof with the side wall work surfaces located between the nose and the edge work surfaces.

12. Apparatus as in claim 11 wherein the edge work surfaces have leading ends with pointed configurations that are directed toward the nose.

13. Apparatus as in claim 11 wherein the edge work surfaces include smoothly curved leading ends and axial trailing ends that interconnect the edge surfaces at upper and lower locations.

14. Apparatus as in claim 13 wherein each edge work surface includes a pair of parallel intermediate surface portions extending between the leading and trailing ends.

15. Apparatus as in claim 11 wherein the die work opening has the side wall work surfaces thereof extending away from each other in an outwardly opening direction, and the pair of side wall work surfaces of the punch extending from the punch nose to the edge work surface in a complementary relationship to the side wall work surfaces of the die work opening.

16. Apparatus as in claim 15 wherein the end section surface portion of the one projection work surface extends from the support section surface portion thereof in a parallel relationship to the other projection work surface.

17. Apparatus for making a wheel supporting axle and from an elongated tubular axle blank comprising: a female die including an open ended work opening for receiving a tubular axle blank having a pair of end notches forming a pair of end projections; the work opening including a pair of projection work surfaces; one projection work surface having a support section oriented in a skewed relationship with respect to the other projection work surface and an end section extending parallel thereto; the work opening also including a pair of side wall work surfaces extending between the projection work surfaces and extending away from each other in an outwardly opening direction; a male punch that is impacted with the axle blank within the work opening; the punch having a body portion and a nose projecting from the body portion with a rectangular cross section; a pair of projection work surfaces and a pair of side wall work surfaces on the punch body portion complementary to the work surfaces of the work opening in the female die; the punch nose projecting forwardly from the body portion and being received within the axle blank during the impacting; and a pair of spaced edge work surfaces on the punch body portion having pointed leading ends directed toward the nose extending between the projection work surfaces thereof with the side wall work surfaces located between the nose and the edge work surfaces.

18. Apparatus for making a wheel supporting axle and from an elongated tubular axle blank comprising: a female die including an open ended work opening for receiving a tubular axle blank having a pair of end notches forming a pair of end projections; the work opening including a pair of projection work surfaces; one projection work surface having a support section oriented in a skewed relationship with respect to the other projection work surface and an end section extending parallel thereto; the work opening also including a pair of side wall work surfaces extending between the projection work surfaces and extending away from each other in an outwardly opening direction; a male punch that is impacted with the axle blank within the work opening; the punch having a body portion and a nose projecting from the body portion with a rectangular cross section; a pair of projection work surfaces and a pair of side wall work surfaces on the punch body portion complementary to the work surfaces of the work opening in the female die; the punch nose projecting forwardly from the body portion and being received within the axle blank during the impacting; and a pair of spaced edge work surfaces on the punch body portion having pointed leading ends directed toward the nose extending between the projection work surfaces thereof with the side wall work surfaces located between the nose and the edge work surfaces.

19. A method for making an axle from a tubular axle blank of a unitary construction comprising: forming a pair of end notches in the blank to provide a pair of projections; cutting off one of the projections so as to be shorter than the other projection; bending the longer projection away from the shorter projection to thereby provide webbed side walls extending between the projections; forming an intermediate axle portion with a rectangular section having spaced side walls and upper and lower walls connecting the side walls immediately adjacent the projections; and deforming side walls of the intermediate axle portion adjacent the rectangular section inwardly toward each other to form an I-beam section with a smaller combined height and width than the rectangular section.

* * * * *

UNITED STATES PATENT AND TRADEMARK OFFICE

CERTIFICATE OF CORRECTION

PATENT NO. : 4,095,450

DATED : June 20, 1978

INVENTOR(S) : Harry Opland, Ralph S. Sharpe, Joseph H. Zawacki

It is certified that error appears in the above-identified patent and that said Letters Patent are hereby corrected as shown below:

Column 8, line 47 "and" should be --end--.

Column 8, line 51 "apair" should be --a pair--.

Column 9, line 25 "and" should be --end--.

Column 10, line 5 "and" should be --end--.

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*